United States Patent [19]

Mermelstein

[11] Patent Number: 5,000,319

[45] Date of Patent: Mar. 19, 1991

[54] NEGATIVE STORAGE PAGE WITH LOCK-IN FLAPS

[76] Inventor: Leon Mermelstein, P.O. Box 320, Denville, N.J. 07834

[21] Appl. No.: 499,566

[22] Filed: Mar. 26, 1990

Related U.S. Application Data

[63] Continuation of Ser. No. 360,988, Jun. 2, 1989, abandoned.

[51] Int. Cl.[5] ..... B65D 85/48

[52] U.S. Cl. ..... 206/455; 402/4; 402/79; 40/159

[58] Field of Search ..... 206/425, 455, 456, 472, 206/473, 495; 229/72; 383/37, 38, 39; 220/22.1, 22.3, 22.5; 40/159; 402/4, 79

[56] References Cited

U.S. PATENT DOCUMENTS

| | | | |
|---|---|---|---|
| 1,217,243 | 2/1917 | Tucker et al. | 206/425 |
| 1,513,514 | 10/1924 | London | 383/39 |
| 1,656,339 | 1/1928 | Runyan | 388/38 |
| 1,980,241 | 11/1934 | Wilson et al. | 229/72 |
| 3,459,361 | 8/1969 | Matton | 229/72 |
| 3,797,146 | 3/1974 | Holes | 402/79 |
| 3,816,948 | 6/1974 | Mooney et al. | 40/159 |
| 3,866,648 | 2/1975 | Anderson | 206/456 |
| 3,936,201 | 2/1976 | Kenney et al. | 402/4 |
| 4,053,057 | 10/1977 | Snowden | 402/4 |
| 4,065,864 | 1/1978 | Stanly | 40/159 |
| 4,170,081 | 10/1979 | Kiejzik | 206/455 |
| 4,173,837 | 11/1979 | Kiejzik | 229/72 |
| 4,184,754 | 1/1980 | Ozeki . | |
| 4,193,118 | 3/1980 | Mermelstein . | |
| 4,247,999 | 2/1981 | Latino | 40/159 |
| 4,401,219 | 8/1983 | Mink | 206/495 |
| 4,533,048 | 8/1985 | Ozeki | 206/456 |
| 4,602,714 | 7/1986 | Izeki | 206/455 |
| 4,629,070 | 12/1986 | Roberg . | |
| 4,635,796 | 1/1987 | Ozeki | 206/456 |
| 4,722,626 | 2/1988 | Abildgaard | 402/4 |
| 4,726,635 | 2/1988 | Rariden et al. | 220/22.1 |

FOREIGN PATENT DOCUMENTS

| | | | |
|---|---|---|---|
| 1492571 | 11/1977 | United Kingdom | 206/455 |

*Primary Examiner*—David T. Fidei

*Attorney, Agent, or Firm*—Mathews, Woodbridge & Collins

[57] ABSTRACT

Translucent or transparent plastic storage pages which include a plurality of parallel laterally-extending top loading pouches for accommodating film negatives. The top sheet of each page has a series of parallel cuts respectively disposed below the top boundary of each of the pouches and coinciding in position with sprocket holes on the film, forming upper and lower flaps. Thus, when the negatives are in place in the pouches, the slit for the pouch closes over the negative strip locking it into place against the row of sprocket holes, and preventing the strip (no matter what the length) from falling out when kept flat or hanging. Beading the page at the slit (or cut) opens the pouch for easy retrieval. Negative strips of any length from 1 to 5 frames can be stored in the pouch.

2 Claims, 4 Drawing Sheets

NEGATIVE STORAGE PAGE WITH LOCK-IN FLAPS

This application is a continuation of application Ser. No. 360,988, filed June 2, 1989, now abandoned.

This relates in general to translucent or transparent plastic storage pages, including toploading envelope-style pouches, for accommodating negatives, more particularly of a type which are adapted for mounting in a three-ring binder, or for hanging in a file cabinet using a hanger bar, or for both of the foregoing.

BACKGROUND OF THE INVENTION

It is known in the prior art to provide storage pages comprising a series of channels for accommodating negatives, which pages are formed of translucent or transparent plastic material. These negative storage pages may be adapted for mounting in three-ring binders, or for hanging in file cabinets using hanger bars, or for both, as disclosed in U.S. Pat. No. Des. 803,928 filed by Applicant on Nov. 7, 1985, which is incorporated herein by reference.

A problem encountered in the prior art with channel-loaded type of negative storage pages having top-loading pockets is that the negatives tend to fall out or to be scratched or bent when being put in place or removed.

It is therefor the principal object of this invention to provide improved plastic pages having toploading envelope-style pouches for accommodating negatives which are locked in place in the page and are prevented from falling out during movement of the binder or filng cabinet or other receptacle, or being bent or scratched during placement or retrieval, especially when the negative strip is shorter than the accommodating channel.

These and other objects are achieved in accordance with the present invention in an improved plastic page for accommodating negatives in top-loading laterally-extended parallel pockets comprising envelope-style pouches.

The negative storage pages are formed, in a preferred embodiment, by overlaying a pair of matching translucent or transparent sheets, say, conventional 8 ½ inches (23.8 centimeters) long by 11 inches (28.5 centimeters) wide. The top edges are fastened together by a first straight line of sealing dots across the top, about ⅝ inch (1 ½ centimeters) below which and parallel to which is disposed a second line of sealing dots forming between the rows of sealing dots an oblong lot closed by a row of dots normal to the inner end. This is shaped for placing an index strip in the page. At the inner end, the corner of the page is cut off at, say, a 45 degree angle. Along the inner and outer long edges and across the bottom, the upper and under sheets are sealed together by straight lines of sealing dots parallel to the edges.

About 1 ¾ inches (4.2 centimeters) below the second row of sealing dots, disposed parallel thereto across the width of the negative storage page, is a third row of sealing dots. A fourth, fifth, sixth and seventh row of parallel sealing dots, each about 1 ¾ inches (4.2 centimeters) below the one above, are extended across the width of the page, each in parallel relation to the line of sealing dots above, providing a series of elongated parallel, laterally-extending upper and lower pouches, each of which is closed at each of its ends by a row of sealing dots.

A salient feature of each of the laterally-extended parallel lower pouches is that, instead of opening across the top edge of the pouch, as in prior art storage pages, the outer surface sheet is cut across the width of the top page with a straight cut, forming an opening parallel to and ⅜ inch (1 centimeter) below the top edge of each pouch. This enables the standard 35 millimeter negative, (1 ⅜ inches wide), to be slipped into the pouch and locked into place, with the upper flap of the upper pouch folded over the top edge of the negative. The position of the cut and the depth of the pouch is such that it always falls across the area of the sprocket holes on the edge of the negative. This has the advantage that the cut does not interfere with the image on the strip in duplicating through the page without removing the negative, as in "proofing".

Margins, say ⅝ inch (1.7 centimeters) wide, are provided along the left-hand and right-hand long edges of the negative storage page by additional straight lines of sealing dots. The left-hand margin in a preferred embodiment of the negative storage page, is punched with three holes for filing in a conventional 3-ring binder. This margin may also serve to accommodate a hanger bar for hanging the page in a filing cabinet.

Other objects, features and advantages will be better understood by a study of the detailed description hereinafter with reference to the attached drawings.

SHORT DESCRIPTION OF THE DRAWINGS

DETAILED DESCRIPTION OF THE INVENTION

Figure 1:
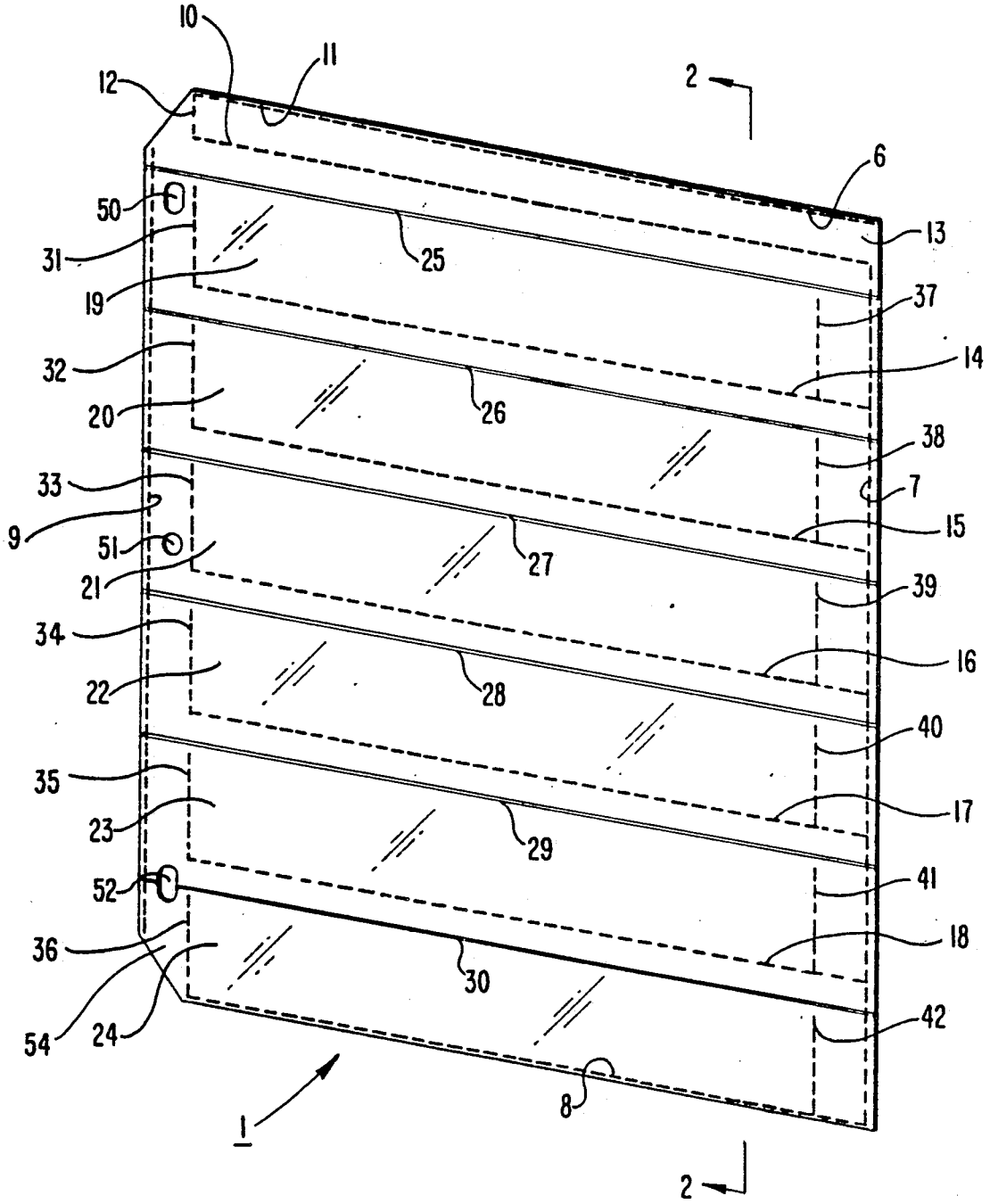
FIG. 1 is a top view of a preferred embodiment of a negative storage page in accordance with the present invention.

Referring to FIG. 1, there is shown a negative storage page in accordance with a preferred form of the invention. This comprises a pair of superposed sheets of translucent or transparent plastic material, such as, for example, low density polypropylene. Such materials may also be characterized as "archival", in that they are not substantially chemically reactive with photographic emulsions.

Figure 3:
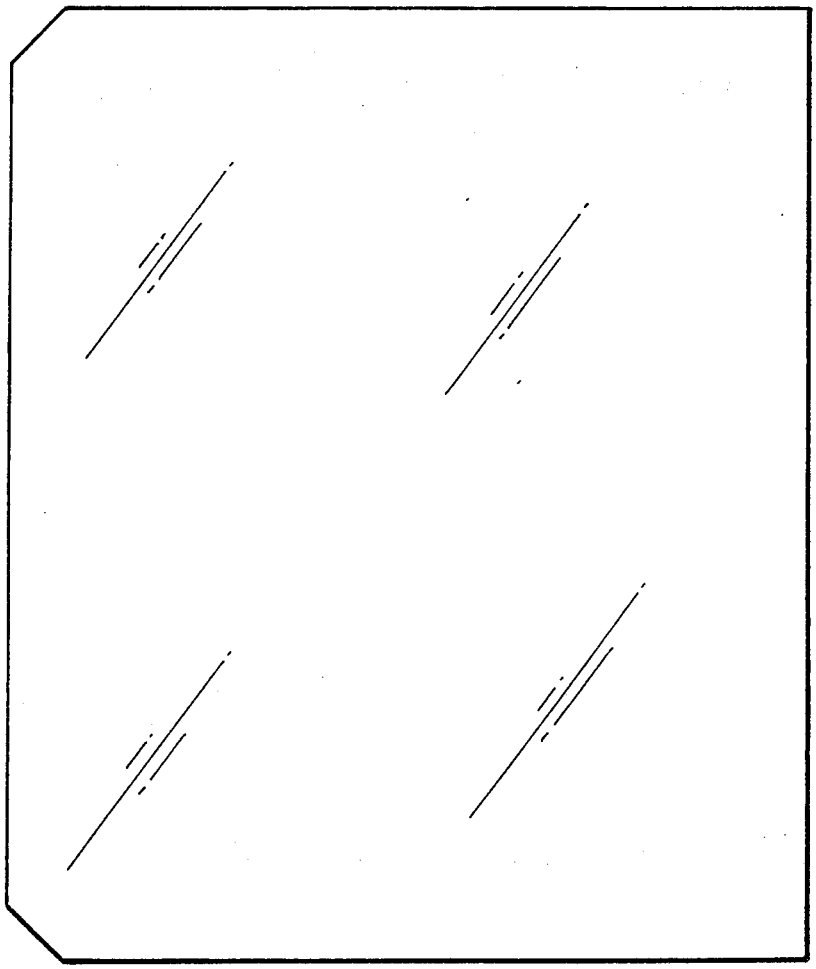
FIG. 3 is a view of the top and bottom sheets of the embodiment of FIG. 1, before the same are sealed together.

FIG. 3 shows the under or bottom sheet 2, which is a plane sheet of plastic 11 ½ inches (28.7 centimeters) long and 8 ½ inches (23.8 centimeters) wide. The upper and lower left-hand corners 3 and 4 are cut off at angles of 45 degrees.

Figure 4:
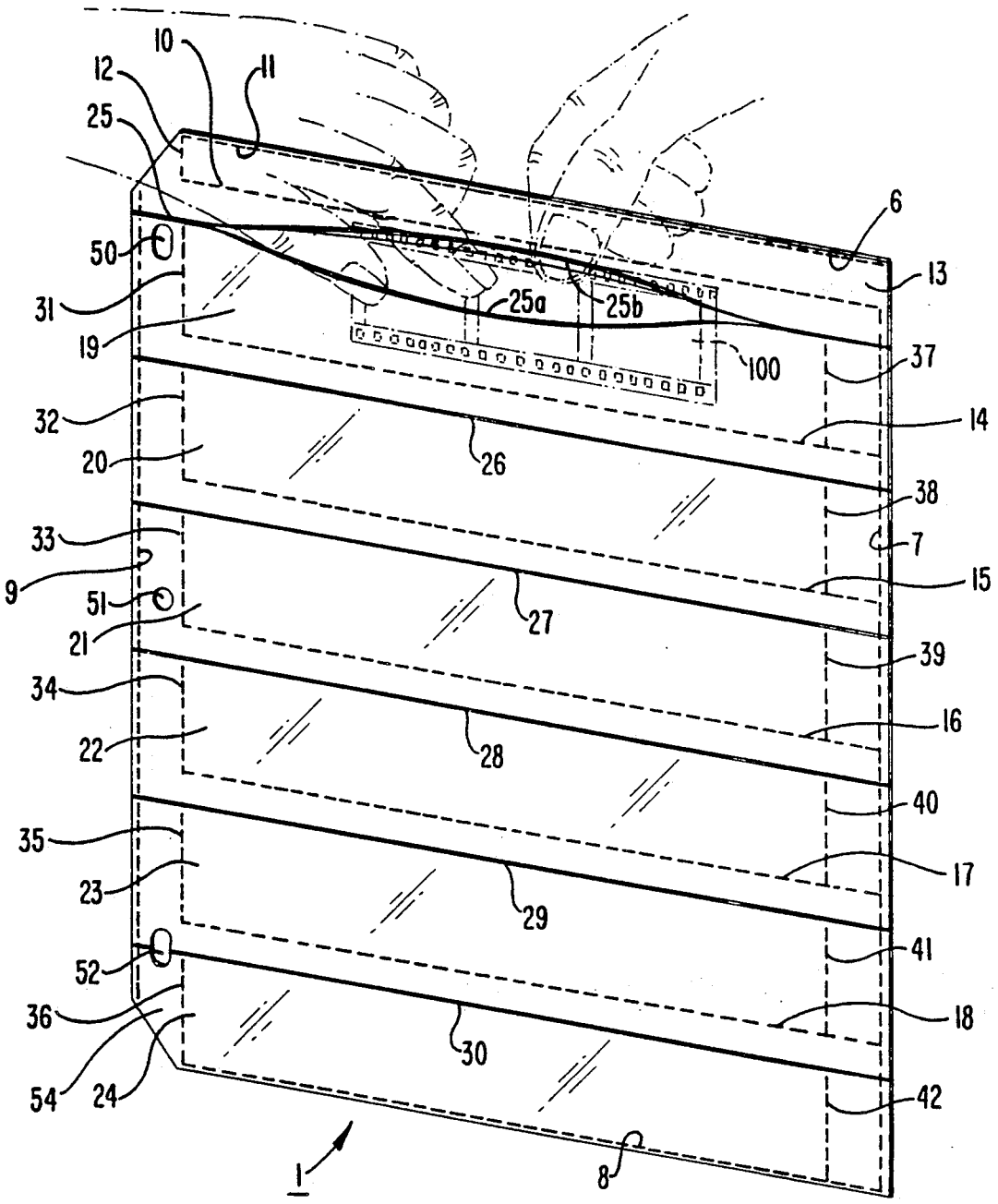
FIG. 4 is a view of the embodiment of FIG. 1 with a negative in the process of being inserted.

Superposed in matching relation on sheet 2 is a second or substantially identical sheet 5, as shown in FIG. 4.

The two sheets are sealed together by lines of sealing dots 6, 7, 8 and 9 parallel to and individually spaced-apart, say, 3 1/6 inches (1-3 millimeters) from the respective upper and lower and lateral edges of the pages. The sealing operation is conventional and may be carried out by any well-known process, such as by spot welding by ultrasonics, heat sealing, etc.

At the top of the superposed sheets, 9/16 inch (1.3 centimeters) below and parallel to the top sealing line 6, is a second line of sealing dots 10 which conforms to the length of line 6, forming between lines 6 and 10 an open channel 11, which is closed on its left-hand end by a row of sealing dots 12 normal to the ends, and is open at the other end 13.

Parallel to and coextensive with the line of sealing dots 10, and spaced-apart below at intervals of 1 ¾ inches (4 ½ centimeters), are respective lines of sealing dots 14, 15, 16, 17 and 18. These form the sealed bottoms of a plurality of laterally-extended lower pouches 20, 21, 22, 23 and 24.

Figure 2:
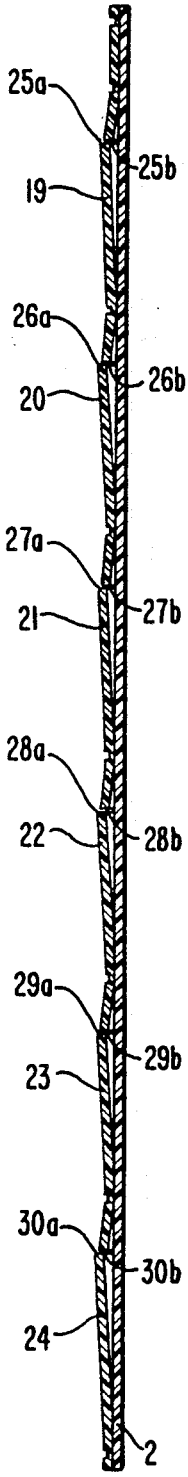
FIG. 2 is a sectional view along the plane indicated by the arrows 2—2 of FIG. 1.

A particular feature of this invention is a series of cuts 25, 26, 27, 28, 29 and 30, each running the width of the top sheet of the negative page, and respectively disposed parallel to and ⅜ inch (one centimeter) below the lines of sealing dots 10, 14, 15, 16, 17 and 18, which form the top upper edges of each of the lower pouches 19, 20, 21, 22, 23 and 24. Each of the lower pouches is closed at the bottom, in each case being 1.39 inches (3.4 centimeters) deep, the depth of each of the pouches being critical, so that when the negative is installed in place, each of the cuts 25, 26, 27, 28, 29 and 30 falls in the area of the sprockets along the upper edge, which in each case, forms a margin 3/16 inch (½ centimeter) wide along the edges of the negative. Thus, the sprocketed edge protrudes slightly 1/16 inch (2 millimeters) above the edge of the cut. This enables the upper flaps **25*b*, 26*b*, 27*b*, 28*b*, and 29*b* formed above each of the cuts to be locked over the edge of the respective cuts during storage. (See FIGS. 2 and 4**.) For retrieval, the page is slightly bent at the cut, and the protruding sprocketed edge of the film is readily grasped and removed.

The lower pouches 19, 20, 21, 22, 23 and 24 are respectively closed at each of their ends, by orthogonally-extending lines of sealing dots, 31, 37; 32, 38; 33, 39; 34, 40; 35, 41; and 36, 42. The latter provide left-hand and right-hand margins 5/8 inch (1.7 centimeters) and 3/4 inch (2 centimeters), respectively, along the length of the page.

In the present embodiment, the left-hand margin is provided with the punched holes 50, 51 and 52, each about ¼ inch (0.6 centimeter wide), which are adapted to accommodate the rings of a conventional 3-ring binder. Alternatively, a hanger bar can be placed in the left-hand margin for storage in a cabinet.

Figure 5:
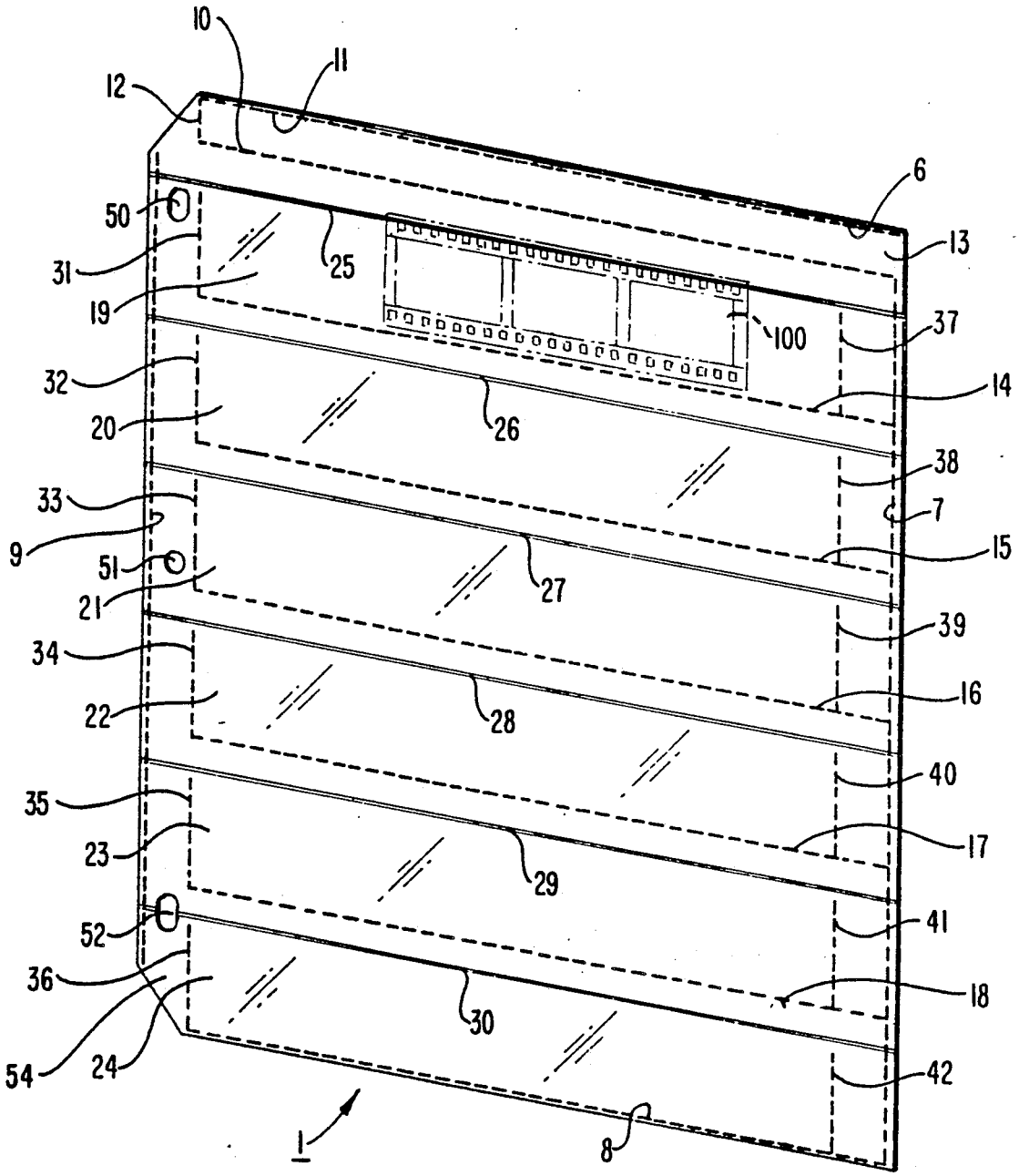
FIG. 5 is a view of the embodiment of FIG. 1 with a negative locked into place.

FIG. 4 shows a negative storage page in accordance with FIG. 1 into which a conventional negative, which is 35 millimeters wide and has sprocketed edges a few millimeters wide, is in the process of being installed in the uppermost one of the lower pouchs 19 by opening up both the lower flap **25*a*, which is just less than 35 millimeters deep, and the upper flap 25*b*, say, ⅜ inch, which is, (8 millimeters) deep. Thus, when the two flaps are closed in place, the opening 25 is below the top edge of the negative, aligned with the sprocket holes, locking the negative in place, as shown in FIG. 5**.

Although the presently described embodiment includes a lateral channel 54 for accommodating a hanger bar for mounting the negative storage pages in a conventional file cabinet, and the punched holes 50, 51 and 52 for alternative filing of the pages in a 3-ring binder, it will be understood that the invention can be applied to negative storage pages designed for different types of filing systems.

Although the present embodiment discloses a negative storage page which is designed for the storage of conventional 35 millimeter film, it will be apparent that the same principal is applicable to films of different dimensions. In each case, the storage pouches have a depth which is a few millimeters less than the width of the negative. Thus, the sprocketed edge of the stored negative protrudes slightly above the edge of the cut, which falls across the sprocketed area.

It will be apparent that the negative storage page of the present design is adapted to hold negative strips of any length, long or short, within the width of the page, which are retained and kept from falling out during storage.

The present invention is not to be construed as limited to the embodiments disclosed herein by way of illustration, but only by the recitations of the appended claims.

What I claim is:

1. A negative storage page for holding, viewing, and storing photographic film strip negatives, which page comprises a pair of sheets comprising an undersheet and an oversheet of translucent or transparent plastic material fastened together by a plurlity of seal lines comprising:

a first set of seal lines extending in equally spaced-apart parallel relation in a width direction across said sheets;

a second set of seal lines disposed to intersect the lines of said first set orthogonally at their opposite lateral ends, each of the lines of said second set extending toward the top of said pages from said intersections to just below the next succeeding seal line of said first set;

a third set comprising a pair of seal lines extending along opposite lateral edges of said sheets, substantially parallel to and forming a lateral margin with the seal lines of said second set;

a series of cuts interposed across the width of said oversheet in equally spaced parallel relation beneath each of said first seal lines;

wherein said cuts and said seal lines form between them beneath each of said first seal lines an elongated upper pouch and a deeper lower pouch each closed on three sides and having their respective upper and lower edges in facing relation, the depth of the lower pouch being slightly less than the standard width of the negatives to be stored; and wherein each said upper pouch is constructed to close said cut for locking negatives in place in each said lower pouch.

2. The combination in accordance with claim 1 wherein said lateral margin is adapted to accommodate a hanger bar to be suspended in a file cabinet and is punched to be alternatively accommodated in a three-ring binder.

* * * * *